US011691808B2

(12) United States Patent
Kotora

(10) Patent No.: US 11,691,808 B2
(45) Date of Patent: Jul. 4, 2023

(54) DUAL PURPOSE INTERMODAL TANK CONTAINER

(71) Applicant: Ondrej Kotora, Macklin (CA)

(72) Inventor: Ondrej Kotora, Macklin (CA)

( * ) Notice: Subject to any disclaimer, the term of this patent is extended or adjusted under 35 U.S.C. 154(b) by 133 days.

(21) Appl. No.: 17/497,922

(22) Filed: Oct. 9, 2021

(65) Prior Publication Data

US 2022/0055830 A1 Feb. 24, 2022

Related U.S. Application Data

(63) Continuation-in-part of application No. 16/004,356, filed on Jun. 9, 2018, now abandoned.

(51) Int. Cl.

| | |
|---|---|
| ***B65D 88/12*** | (2006.01) |
| ***B65D 88/62*** | (2006.01) |
| ***B65D 90/04*** | (2006.01) |
| ***B65D 90/24*** | (2006.01) |

(52) U.S. Cl.

CPC ..... *B65D 88/62* (2013.01); *B65D 88/128* (2013.01); *B65D 90/046* (2013.01); *B65D 90/24* (2013.01); *B65D 2590/043* (2013.01); *B65D 2590/24* (2013.01)

(58) Field of Classification Search

CPC .... B65D 88/128; B65D 88/129; B65D 88/62; B65D 88/121; B65D 90/046; B65D 90/10; B65D 90/24; B65D 2590/043; B65D 2590/24

USPC ..... 220/1.5, 530

See application file for complete search history.

(56) References Cited

U.S. PATENT DOCUMENTS

| | | | | |
|---|---|---|---|---|
| 2,628,673 | A * | 2/1953 | Ericson | B60K 15/00 137/565.17 |
| 2,758,747 | A * | 8/1956 | Stevens | B65D 88/62 406/146 |
| 3,477,611 | A * | 11/1969 | Niles | B60K 15/03 220/202 |
| 3,918,604 | A * | 11/1975 | Kersten | B65D 88/62 105/248 |
| 3,971,491 | A * | 7/1976 | Mowatt-Larssen | B65D 88/128 220/628 |
| 4,174,741 | A * | 11/1979 | Parsons | B65D 88/62 141/2 |
| 4,178,868 | A * | 12/1979 | Iizuka | B63B 25/08 114/74 R |
| 4,210,254 | A * | 7/1980 | Parsons | B65D 88/62 222/154 |

(Continued)

*Primary Examiner* — Joshua E Rodden

(57) ABSTRACT

A dual-purpose tank container is provided, designed for transporting unrefined or refined fluid within the same internal space, eliminating unproductive deadheading. The tank container includes an inner tank in a frame, and outer insulation shell, the tank being equipped with at least one diaphragm so that a fluid, for example crude oil or diesel fuel, can occupy inner space without risk of contamination from a residual fluid. The high viscosity unrefined fluid can be almost completely drained using fluid draining channels present on the diaphragm surface, increasing transportation economy and eliminating any residual fluid pockets. At least one inlet present on the upper tank body supplies a solvent vapor/fluid to condition the space between the diaphragm and the tank wall, thereby preventing sticking of the diaphragm to the tank inner surface.

2 Claims, 3 Drawing Sheets

(56) References Cited

U.S. PATENT DOCUMENTS

| | | | | | |
|---|---|---|---|---|---|
| 4,307,812 | A * | 12/1981 | Gerhard | B65D 88/128 | 220/1.5 |
| 4,376,489 | A * | 3/1983 | Clemens | B65D 88/128 | 220/900 |
| 5,027,860 | A * | 7/1991 | Tuthill, Jr. | B65D 88/62 | 138/30 |
| 5,083,673 | A * | 1/1992 | Fossey | B65D 88/128 | 220/4.12 |
| 5,197,658 | A * | 3/1993 | Sprunger | B65D 25/16 | 220/916 |
| 5,390,806 | A * | 2/1995 | Elston | B65D 88/128 | 220/1.5 |
| 5,778,679 | A * | 7/1998 | Celorier, Jr. | F15B 1/12 | 62/47.1 |
| 5,779,077 | A * | 7/1998 | Fossey | B65D 88/128 | 220/1.5 |
| 6,012,598 | A * | 1/2000 | Antoniou | F17C 13/084 | 220/668 |
| 6,527,002 | B1 * | 3/2003 | Szakaly | B65D 90/38 | 220/88.1 |
| 2015/0004013 | A1 * | 1/2015 | Giovangrossi | B60T 17/06 | 417/274 |

* cited by examiner

DUAL PURPOSE INTERMODAL TANK CONTAINER

CROSS-REFERENCE TO RELATED APPLICATIONS

This application is a continuation-in-part of application Ser. No. 16/004,356, filed Jun. 9, 2018, now abandoned.

BACKGROUND OF THE INVENTION

This invention relates to a commodity carrier. More particularly it relates to an intermodal tank container type carrier adapted to transfer any number of loadings of two different viscosity liquids without subjecting either liquid to contamination by residue of the other. At least one diaphragm is arranged completely around the inside of the cylindrical tank, and its surface is equipped with a plurality of ridges with fine edges.

DESCRIPTION OF RELATED ART

Pipelines are thought to be the most economical way to transfer petroleum from its raw source, crude oil producer, to a refinery for refining and production of petroleum distillates, and finally to the final customer. Since they are stationary, they require various additional transport services, for example first or last mile trucking in and out of pipeline storage facilities, or rail and sea transport with additional infrastructure needed for loading and unloading of cargo. The related additional costs are not always obvious, and are known to the one skilled in the art. The petroleum transfer logistics includes many cases of deadheading, when there is no cargo transported on the return trip of the cargo transporter. The proposed dual-purpose intermodal tank container would at least partially improve the economics of the unrefined/refined petroleum transport.

Since the tank container is intermodal, it has standard structural dimensions. Such a tank container is possible to transport from a cargo loading source to the designated destination continuously using standardized cargo transporters via road, rail or marine, without need for building expensive petroleum transfer infrastructure.

The economics of such a logistic solution would excel in an environment, where there is substantial price differential between two commodities. For example, in Western Canada, there is a difference between the price of unrefined and refined petroleum products compared to the US gulf coast where the same price difference is transposed.

It makes economic sense, to load a load of crude oil as close as possible to a production source in Canada, transport the load to a refinery in the US Gulf Coast, and return back to Canada with a load of gasoline or other petroleum refined product.

Such a logistic solution is very well competitive with pipeline or rail petroleum transport. It is believed that pipeline is on average 20 percent less expensive than rail especially in case of longer routes (Kyle Bakx, 2017). But pipeline streams a product only one way. Additionally, in case of heavy crude oil and bitumen, which is the majority petroleum product in Western Canada, there is need for a thinning agent, such as diluent, which conditions the crude oil for pipeline transport. This need adds on average 30 percent of volume to the transported crude oil (Spackman, 2016). There are also costs related to other conditioning of the crude oil before it can be transported via pipelines. Example is removal of solids and water content below 0.5 percent of the volume. Rail transport is not so stringent in requirements for water and solid content of the transported crude oil. After factoring in all possible costs, the rail transport can be cost competitive with pipelines or can be even more economic in case of heavy oil. Although rail transport can also benefit from utilization of return trips, it still needs transfer stations which are expensive to build and maintain. It also utilizes designed railway cars with inherent safety flaws.

Viscous bitumen, produced in the Canadian province Alberta, as an example of unrefined petroleum, carries a significant market price discount. There are two factors forming this discount, qualitative and geolocational.

The bitumen is very heavy and sour crude with average 4% sulfur content and 20% volume of asphaltenes (Strautz, 1977). It had been standard to refine lighter crude oil grades until the advent of more complicated refining processes, such as coking and hydrotreating, allowed economical refining of heavier crude oil grades. For such complex refineries, extra heavy crudes represent so-called opportunity crudes, which are harder to refine, but yield more product volume especially when natural gas price is low.

The presented invention solves some of these problems. The transported heavy crude oil doesn't need to be diluted to the usual 3:7 ratio (diluent:crude oil), it just needs to attain a certain lower viscosity so it can be unloaded from the container using the diaphragm pressurized from the opposite compartment. A specialized pump, which utilizes flow sensors, registers pumped crude oil composition and adjusts the injection of the chemicals accordingly. The crude oil cargo travels from source to a refinery usually quite a few days. This time can be utilized for preconditioning of the crude oil according to the refinery needs. The container tank can be equipped with an optional tray on the bottom. This tray represents about 2.5% of the tank volume and is designed for aggregation of unwanted precipitate, which can stay there until the container tank returns to the point of origin. The tray is then washed out according to sediment level, using the loading pump system and a solvent.

There is a significant advantage hidden in such a system. The content of every batch represented by every single container tank, with capacity approx. 300 barrels, is described using above mentioned sensors in the loading pump flow lines, and thus there is possibility to construct a specific crude oil essay for every set of these batches. The container tanks are not limited just for heavy oil, they can be utilized for light oil as well as various condensates. It is possible to prepare complete refinery blends which can be blended on the fly while being unloaded from a sea vessel directly into refinery charging tanks. Such a designed system would skip many problematic refinery segments and crude oil blends preparation steps, such as dewatering, desalting, blending and chemical preconditioning.

The geolocational factor of the discount represents transportation costs. The production source of the Canadian bitumen is landlocked in the province of Alberta. The pipeline capacity has its limits, and crude oil producers and transporting companies are eager to find ways to get the oil to the tidewaters. The other economically acceptable option, beside pipelines, is railway transport. Conventional tank car trains require loading and unloading stations, which are costly to build and maintain. While containerized oil transportation can be merged into existing flow of general cargo containers. It is a fact known to the ones skilled in the art, that container slots in intermodal trains are underutilized. On average, railway well cars are loaded to about 50% of their weight capacity (Pickel, 2015). The intermodal railway transportation is a special example of underutilization since, in North America, there is uneven flow of full containers from west to east coast and flow of empty containers the other way. In an average 100 car train, there are always at least two locomotives, a rule independent of the train weight requirements. Higher tonnage per car would represent just some percentage higher fuel cost, since all other capital costs, equipment, manpower etc., are fixed per train. A five-well intermodal double stack flat car can carry ten containers. Allowed tonnage per each of the middle wells is about 55 tones and 70 tones at each end well. Such an average multiwell railway car can carry, for example, four FEU tanks with bitumen weighing 50 tons, two FEU with general cargo 2×25 tons, another two empty FEUs 2×5 tons, and two 53 domestic reefers weighing 20 tons each. In this configuration, the rail car tonnage capacity would be almost fully utilized.

The same utilization problem exists in marine container transport. Just the costs are the same for both ways, since a steamship burns fuel hauling ballast water when traveling underutilized. An example would be transport of bitumen from Alberta to California west coast refineries using the proposed invention. The container is loaded at a production oil field in the Athabasca region and travels on a truck trailer chassis to the nearest intermodal container yard near Fort McMurray. There the container is merged with other tank containers on an intermodal double stack train, travels to Edmonton to an intermodal container yard, is mixed with general cargo intermodal containers and is shipped to Vancouver. There it is loaded onto a special RoRo (roll on roll off) steamship, which has container tank slots on the bottom under deck equipped with pumps. The RoRo steamship can also load general cargo containers above deck. With full container tanks of bitumen on the bottom, there would be still enough tonnage capacity to load above deck slots with empty general cargo containers. The steamship would travel to a California coast refinery, unload bitumen at a berth and load diesel fuel or any other refined product. The ship would stop at Long Beach seaport, unload empty general cargo containers located above deck, load full ones and travel back to Washington/B.C. coast. The refined products could be unloaded along the way at any suitable port or terminal. The full general cargo containers can be transferred at the same port as the empty tank containers onto an intermodal train and travel to Edmonton to an intermodal yard.

The proposed intermodal logistic solution is designed to be superior to both currently existing petroleum transport modes, pipeline and standard rail. It eliminates most of the cost related to cargo transfer between modes whenever it is necessary. In the best case, the unrefined petroleum is loaded at the oilfield using its own designed intermodal containerized pump into the intermodal tank container. The crude oil producer is not required to build any additional infrastructure, just provide access to the right riser outlet at the crude oil source tank farm or flowline. The fluid is loaded only once right at the source and unloaded at the final destination at the refinery using a similar model of intermodal pumps located therein. This is the most important point of the proposed logistic solution, and the scope of its effects is obvious to those skilled in the art.

Majority of the larger oil producers have pipeline access at their oilfield. They need to set up processing facilities for conditioning of produced crude oil before it is pipelined via small local pipelines to the major pipeline terminals. Sometimes they get restricted on available volume for transfer, thus implying a need for road trucking of the extra produced crude oil to the nearest transfer terminal. It all adds to the cost. The proposed logistic solution can accept crude oil right at the source oil well leases, after moderate conditioning. Thus, bypassing all the flowlines and processing facilities.

After loading crude oil, the intermodal tank container is trucked to the nearest railway depot where it is quickly transferred using standard container handlers, either mobile or stationary, onto a railway well car. A suitable five-unit articulated double stack well car is the best choice for such a transport since the deadweight including the container tare weight is comparable to a standard railway tank car tare weight. After the train is loaded it travels to a refinery where the tank containers get unloaded and optionally subsequently or simultaneously loaded with refined products. It would be also possible to transload the tank containers onto suitable container steamship, equipped with an unloading mechanism similar to the designed container pump. Such transport design would allow unloading of cargo at a refinery river or sea berth, which is a standard part of river or seaside refineries. The refined products, loaded into the secondary compartment of the container tank, can travel all the way back to the starting point of the trip, or be unloaded at a suitable destination, and the container returns to the starting point empty.

BRIEF SUMMARY OF THE INVENTION

In today's world, speed and modularity dominate the global transportation system. The presented invention implements such system properties in petroleum transport logistics. Using a dual purpose intermodal tank container, it can facilitate unrefined petroleum transport from an oilfield to a destination refinery via various combined modes of transport. In order to maximize economic benefits from transporting cargo both ways, the dual-purpose intermodal tank container can be loaded at a destination refinery with refined petroleum and delivers such cargo to customers on the way back to an oilfield. The primary goal of the invention is utilization of tonnage capacity and elimination of deadheading.

DETAILED DESCRIPTION OF THE INVENTION AND ITS PREFERRED EMBODIMENT

The tank container frame has standard intermodal ISO container dimensions. This way it can be transported in different modes without additional requirements. The design respects weight restrictions, primarily for road transportation, whose complete scope is known to those skilled in the art.

Figure 1:
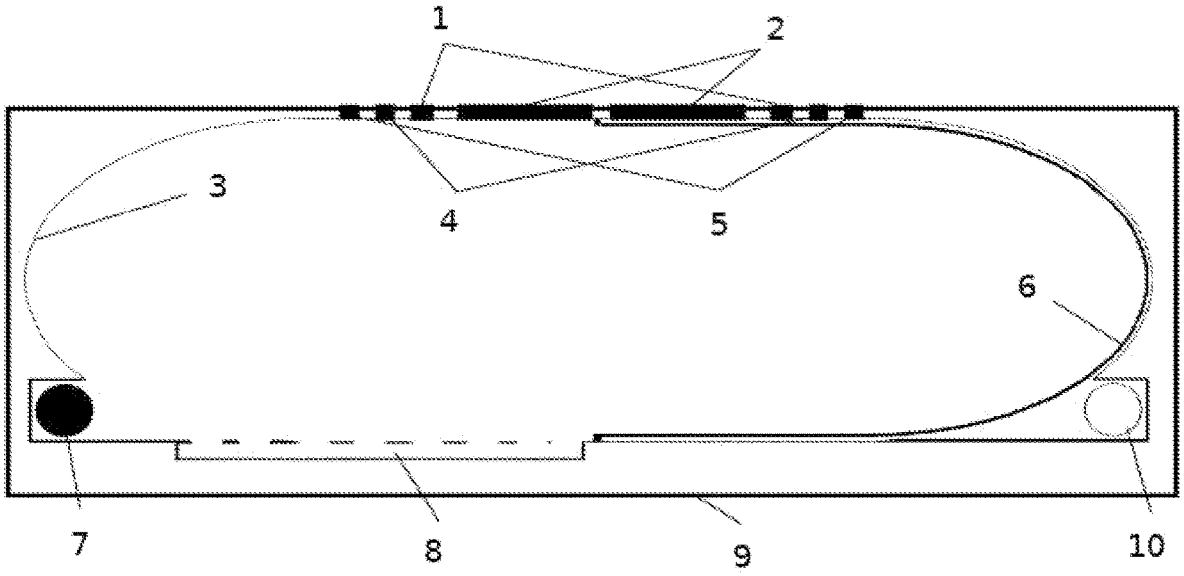
FIG. 1 is an example of cross sectional side elevation of an embodiment of the intermodal tank container, to provide context.
Figure 2:
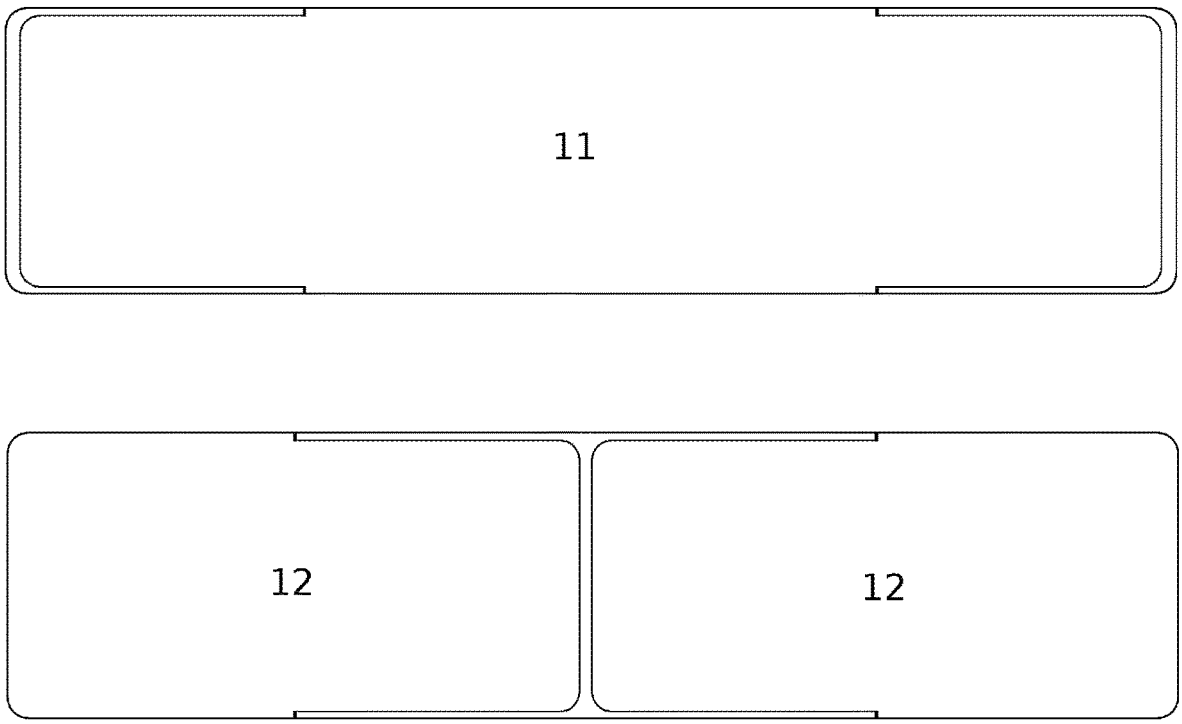
FIG. 2 is a simplified side view in the cross section of the multi-diaphragm version of the invention in two different stages of the transportation process. Top one is transporting refined liquid, the bottom one is transporting unrefined liquid.

The tank diaphragm 6 intersects the tank girth wise in the middle in case of single diaphragm tank (FIG. 1) or any-where else in case of multiple diaphragm tank (FIG. 2). In the two compartment tank in the FIG. 1, the diaphragm copies half of the tank shape and can turn inside out into the other side of the tank when pressured by gas or liquid. The tank halves are both designed for different use. The left compartment is for unrefined petroleum, the right compartment is for refined petroleum. Unrefined petroleum can be very viscous and sticky, for example, extra heavy oil hardly flows in ambient temperatures. Therefore, the left compartment could be optionally equipped with a heating mechanism in the form of electric heating cables applied on the bottom of the tank compartment. There is also an option of a container tank without heating elements, but requiring additional dilution of the unrefined petroleum. The tank has an optional insulation layer within the space between tank wall 3 and second shell 9 formed from light composite material. When the left compartment, containing viscous crude oil, is being emptied, the diaphragm propagates pressure from injected gas or liquid pressured into the right compartment, thus pushing on the viscous fluid and accelerating the unrefined petroleum unloading process.

Each half of the tank has a loading/unloading single inlet/outlet on the bottom 7,10. Tank halves are further equipped with pressure relief valve 4 and excessive vacuum breaker valve 5. There is also a manhole 2 dedicated to each of the tank compartments for servicing of internal parts. An optional sediment tray 8, can be also present, for accumulation of unwanted precipitates during transportation.

Figure 3:
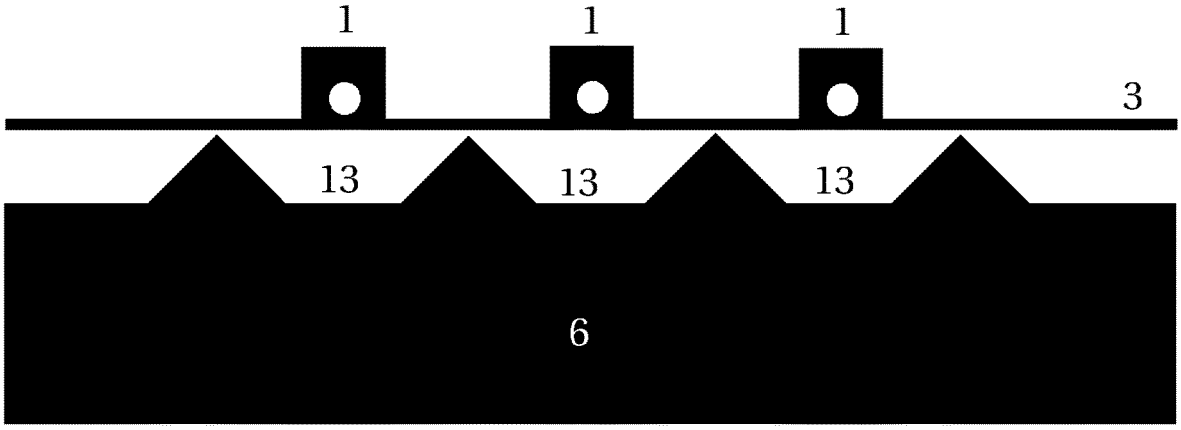
FIG. 3 is an enlarged fragmentary view in the cross section of the tank diaphragm in contact with the tank wall.

In order to allow the emptied part to be almost completely drained of liquids, the diaphragm body 6 has a special patterned surface (FIG. 3), which forms draining fluid channels 13 even if fully pressed against the tank internal wall 3. These channels are designed to drain towards the inlet/outlet location 7 on the compartment bottom. Proper draining of liquids is essential for the economy of the whole transportation process.

Each compartment is also equipped with at least one injection/suction inlet/outlet 1 on the upper portion of the tank. Especially the compartment(s) designed for unrefined liquid, where high adhesivity of the residual liquid is expected, can benefit from multiple solvent vapour inlet 1 configuration, as shown on FIG. 3. A single inlet 1 is also possible in case of centered star shaped pattern on the diaphragm fluid draining channels. Utilization of the vapor solvent fluid supplied via inlet(s) 1 together with the function of drain channels 13 on the diaphragm surface is necessary for prevention of differential sticking of the diaphragm to the tank wall in very cold temperatures due to increased viscosity and adhesivity of the residuum. The transported unrefined liquid has expected viscosity of 2000 cP, which is about the same as maple syrup, at the point of unloading. The residuum present after unloading of the compartment can reach viscosity of 250000 cP or higher in very cold temperatures of Northern Alberta. The untreated associated adhesivity would represent serious risk for the integrity of the tank diaphragm.

The logistic system is designed to exert minimal implementation cost on its customers. In order to achieve such an objective, it needs an element which supplies fluid transfer function. This is achieved using intermodal containerized pumps for fluid loading or unloading to and from the intermodal tank container. As the pump container is itself intermodal, it can be transferred together using the same means as the intermodal tank container. The pump container consists of two pumps, each one can supply loading or unloading functions according to a situation. There is also a dedicated small solvent vapor fluid pump for priming of the tank diaphragm patterned surface at the end of the unloading process. A nitrogen generator installed to supply sufficient flow of nitrogen gas needed for cooling or preparation of an inert environment inside the container tank, is also present. The intermodal pumps are both equipped with a flexible hose which, at best, automatically connects to the close sidewise positioned intermodal tank container inlet valve 7,10. This connection process can be also achieved using a telescopic bridge automatically governed from the inside of the pump container. Once the fluid flow channel is established, the fluid transfer process can begin. At best, the unloaded fluid present in the first tank compartment being unloaded by the first pump is pushed against the outlet on the bottom of the tank with help of the diaphragm 6, which is itself being pushed by the incoming fluid loaded into the second tank compartment inlet by the second pump. Such a push effect can be also achieved by a generated nitrogen gas pressured into the second compartment. Using both pumping actions simultaneously is optional, but desired as it represents significant time savings as it allows unloading and loading the tank container at the same time. Naturally, also an empty container can be simply filled up with the incoming fluid while the solvent vapor supply inlet 1 removes present gases which would otherwise compress and prevent proper filling of the tank. At the loading/unloading location, the containerized pump is connected to a dedicated fluid riser(s) which provides a channel for ingoing or outgoing fluid(s). The whole system transfers petroleum fluids in very small batches, and as such each one can be chemically customized or diluted according to composition of the fluid and/or requirements of the final customer.

There are two designs of the intermodal container tank considered. Small version which is 20 feet long (TEU), 8 feet wide, 8.5 feet high, and the large version 40 feet long (FEU), 8 feet wide and 8.5 feet high. TEU has cargo weight capacity approx. 24 tones, FEU approx. 45 tones. FEU weight is non-standard for a similar container of such size, but it is still within limits for Canadian road transport, which is 63 tones for a truck GVW (Gross Vehicle Weight) (Alberta, 2018). In most US states the road GVW weight limit is 80000 Lbs. (Transportation, 2003), which, absent a special permit, technically prevents road movements of FEU container tanks within the US. Although FEU is nonstandard and overweight, it is still within the limits of mainstream heavy duty standard container yard lifting equipment. TEU intermodal tank has two compartments divided by a single diaphragm. FEU has three compartments, divided by two diaphragms. The two diaphragms form one middle 11 and two divided compartments 12 at each end. The volumes of the middle and the two side compartments together are equal when filled up, thanks to the plasticity of the dividing diaphragms. The side compartments 12 are designed for unrefined petroleum, where the diaphragms provide secondary containment measure in case of the tank wall breach (dividing the tank volume of 300 barrels into 2×150 barrels). Middle compartment 11 is designed for refined petroleum. All three compartments have their own excessive vacuum breaker valves and overpressure control valves together with a dedicated manhole. They are also equipped with pressure and tank level sensors.

The invention has now been described with reference to preferred embodiments. Substitution of parts and other modifications will now be apparent to persons of ordinary skill in the art. In particular, the present invention may be utilized to transport refined or unrefined liquid other than petroleum, such as tallow or other biofuel feedstock.

Accordingly, the invention is not intended to be limited except as provided by the appended claims.

The invention claimed is:

1. An Intermodal tank container adapted to accommodate loading or unloading of unrefined and refined liquids at the same or separate times, comprising at least two compartments separated by flexible diaphragm, said diaphragm having:

sufficient tensile strength to allow unloading a first compartment of the at least two compartments with higher viscosity liquid using pressure applied from an opposite second compartment of the at least two compartments;

impermeable structure to avoid cross contamination;

arrangement completely around an inside of the tank, forming symmetrical tank sections;

a patterned surface equipped with plurality of ridges with fine edges;

said tank having a wall equipped with at least one inlet supplying solvent fluid for conditioning of a residuum between the diaphragm and tank inner surface areas.

2. The Intermodal tank container as set forth in claim 1 wherein said tank has a sediment tray on a bottom of one of the at least two compartments.

* * * * *